United States Patent [19]

Araki et al.

[11] Patent Number: 4,616,443

[45] Date of Patent: Oct. 14, 1986

[54] REVERSIBLE WINDOW STRUCTURE

[75] Inventors: Tokio Araki; Iwao Aoki, both of Toyama, Japan

[73] Assignee: Sankyo Aluminium Industry Company Limited, Japan

[21] Appl. No.: 565,805

[22] Filed: Dec. 27, 1983

[30] Foreign Application Priority Data

Oct. 7, 1983 [JP] Japan ..... 58-186684

[51] Int. Cl.[4] ..... E05D 15/30

[52] U.S. Cl. ..... 49/252; 49/248

[58] Field of Search ..... 49/246, 248, 250, 252, 49/253, 177

[56] References Cited

U.S. PATENT DOCUMENTS

| | | | |
|---|---|---|---|
| 1,011,940 | 12/1911 | Gilson | 160/80 X |
| 1,511,683 | 10/1924 | Soule | 49/252 X |
| 2,017,543 | 10/1935 | Madsen | 49/250 |
| 2,718,675 | 9/1955 | Olsen | 49/252 |
| 3,638,360 | 2/1972 | Vaa | 49/248 |
| 3,936,978 | 2/1976 | Barras | 49/252 |
| 4,007,558 | 2/1977 | Heggdal | 49/252 |
| 4,106,237 | 8/1978 | Bierlich | 49/252 X |

*Primary Examiner*—Kenneth Downey

*Attorney, Agent, or Firm*—Sughrue, Mion, Zinn, Macpeak and Seas

[57] ABSTRACT

A reversible window structure comprising a window frame assembly and a sash member composed of a sash frame assembly and a window glass is disclosed, wherein one end of the sash member is freely moved along the vertical window frames in the up and down direction, while the vertical sash frame is pivotably supported at a position substantially corresponding to the gravity center of the sash member and this supported portion is freely guided in the outdoor direction in a substantially horizontal state.

2 Claims, 8 Drawing Figures

REVERSIBLE WINDOW STRUCTURE

BACKGROUND OF THE INVENTION

1. Field of the Invention

This invention relates to a reversible window structure capable of reversing a sash housed in a window frame. More particularly, the invention is concerned with a reversible window structure which can completely prevent the protruding of the sash from the window frame toward the indoor side during the reversing of the sash and can be reversed through a considerably light operating force by moving a gravity center of the sash in a substantially horizontal state toward the outdoor direction.

2. Description of Prior Art

As a window structure capable of turning a sash housed in a window frame inside out at indoor and outdoor sides, there have hitherto been known vertically rotatable windows and horizontally rotatable windows. In such rotatable windows, however, when the sash is rotated around a vertical or horizontal axis to turn its indoor and outdoor surfaces inside out, both up and down sides or both sides of the sash protrude toward outdoor and indoor sides, respectively, in the course of the turning. Therefore, if a curtain, blind or the like is arranged at the indoor side, it not only obstructs the turning of the sash but also possibly inflicts an injury on persons existent in the room.

For this reason, there is proposed a vertically reversible window adopting the conventional vertically rotatable system but modifying the structure thereof, in which upper and lower portions at one end side of the sash in right and left direction are engaged with upper and lower window frames, respectively, and the thus engaged parts are rotatably moved along the upper and lower window frames in the transverse direction so that substantially the whole of the sash protrudes from the window frame toward the outdoor side but does not protrude toward the indoor side during the reversing of the sash.

In such a vertical reversible window, however, only the one end side of the sash in right and left direction is supported at the engaged part on the upper and lower window frames during the reversing of the sash or at a so-called cantilever state, so that there is particularly a fear of deforming the framing of the sash in case of windows having a longer opening width. If such a deformation is caused, it is difficult to open and shut the sash due to the close contacting of the sash with the window frame, resulting in the injuring of them. Further, the sound insulating performance and water-proof performance are insufficient. Therefore, the conventional vertically reversible window is difficult to be applied to windows with a large opening width.

On the other hand, the inventors have previously developed a reversible window structure utilizing the horizontal rotation system in which the sash can be reversed without protruding toward the indoor side by freely moving one end in the up and down direction of the sash member along the vertical window frames in the up and down direction and pivotably supporting the vertical sash frame member at a position substantially corresponding to a gravity center of the sash. Further, the inventors have made various studies with respect to the concrete improvement of such a reversible window structure. For instance, when the vertical sash frame member is pivotably supported at a position substantially equal to the gravity center of the sash member, the upper end of the vertical sash frame member is pivotably supported by a lower end of a supported arm pivoted to an upper portion of the vertical window frame at such a position that the vertical sash frame member is substantially at the same level as the gravity center of the sash. In this case, the gravity center of the sash changes in up and down direction in accordance with the pivot radius of the arm during the reversing of the sash, so that a large operating force is required and at the same time the reverse operation is apt to become unstable. As a result of the continuation of further studies, the invention has been accomplished.

SUMMARY OF THE INVENTION

Under the above circumstances, it is an object of the invention to provide a reversible window structure utilizing the horizontal rotation system, in which the reversing operation of the sash can stably be conducted through a light operating force by supporting the vertical sash frame member so as to move the gravity center of the sash member in an outdoor direction in a substantially horizontal trajectory, and the reversing of the sash can safely be performed without protruding toward the indoor side where a curtain, blind or the like is existent in the inside of the window, and which is sufficiently applicable to windows with a larger opening width.

According to the invention, the reversible window structure is comprised of a reversible window structure comprising a window frame assembly composed of upper and lower window frames and vertical window frames, and a sash housed in said window frame assembly together with a window glass and composed of upper and lower sash frames and vertical sash frames, characterized in that the upper ends of the vertical sash frames are freely moved along each of said vertical window frames in the up and down direction and at the same time said vertical sash frames are pivotably supported at a position substantially corresponding to the center of gravity center of said sash and the thus supported portion is freely guided at a substantially horizontal state in an outdoor direction.

BRIEF DESCRIPTION OF THE DRAWINGS

The invention will now be described in detail with reference to the accompanying drawings, wherein:

FIGS. 1 to 6 show an embodiment of the reversible window structure according to the invention, wherein FIG. 1 is a schematically longitudinal section, FIG. 2 is a schematically horizontal section, FIG. 3 is a schematic view of an upper end portion of a concave groove formed in a vertical window frame, FIG. 4 is a perspective view of a link assembly supporting the sash, FIG. 6 is a schematic view illustrating an overlapped state of various reversing stages for the reversible window structure.

DETAILED DESCRIPTION OF THE INVENTION

Figure 1:
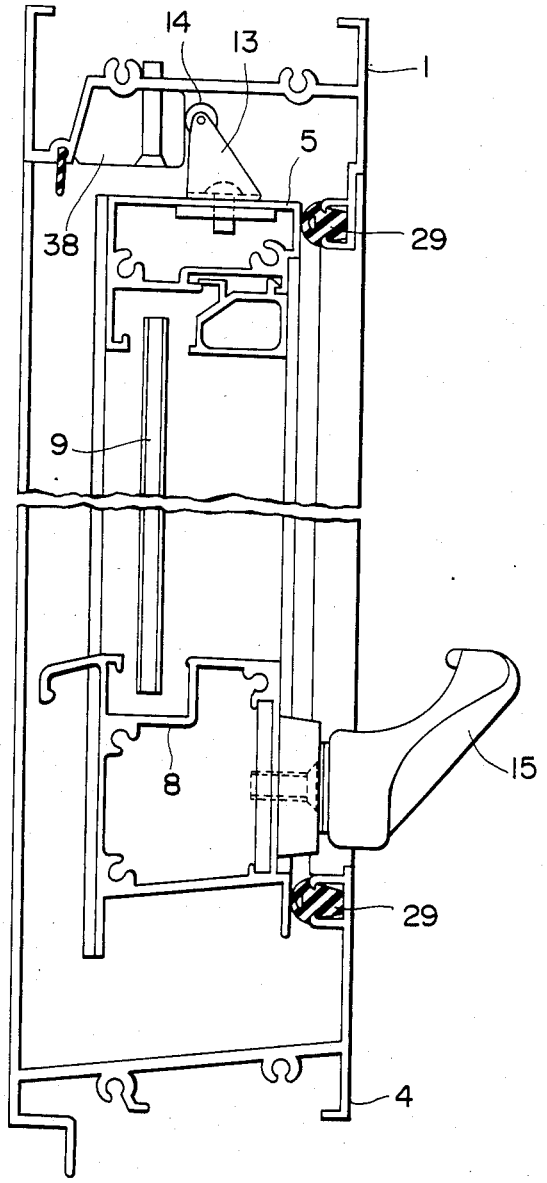

In FIGS. 1 to 6 is shown an embodiment of the reversible window structure according to the invention. In these figures, numeral 1 is an upper window frame member, numeral 2 is a left-side vertical window frame member, numeral 3 is a right-side vertical window frame member, and numeral 4 is a lower window frame member, which are assembled into a window frame assembly. Furthermore, numeral 5 is an upper sash frame, numeral 6 is a left-side vertical sash frame, numeral 7 is a right-side vertical sash frame and numeral 8 is a lower sash frame, which are assembled into a sash frame assembly and then a window glass 9 is attached to the sash frame assembly form a sash member 10.

Figure 2:
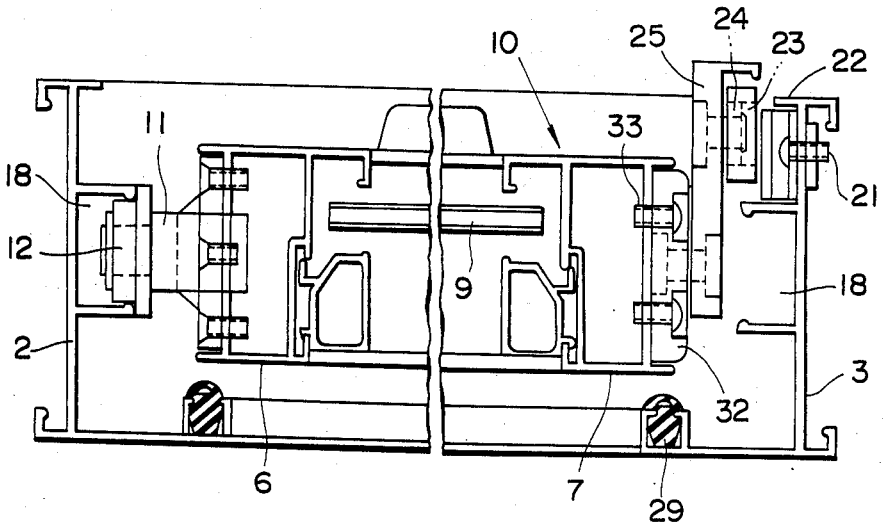

Guide rollers 12 are pivoted by means of fittings 11 on the upper end sides of the sash member 10 on opposite sides thereof (only the left side is shown in FIG. 2) for guiding the upper end portion of the sash member, while a roller 14 for drawing the sash 10 is pivoted to an upper surface side of the upper sash frame 5 through another roller fitting member 13. A lock handle 15 is secured to an indoor side of the lower sash frame 8.

Figure 3:
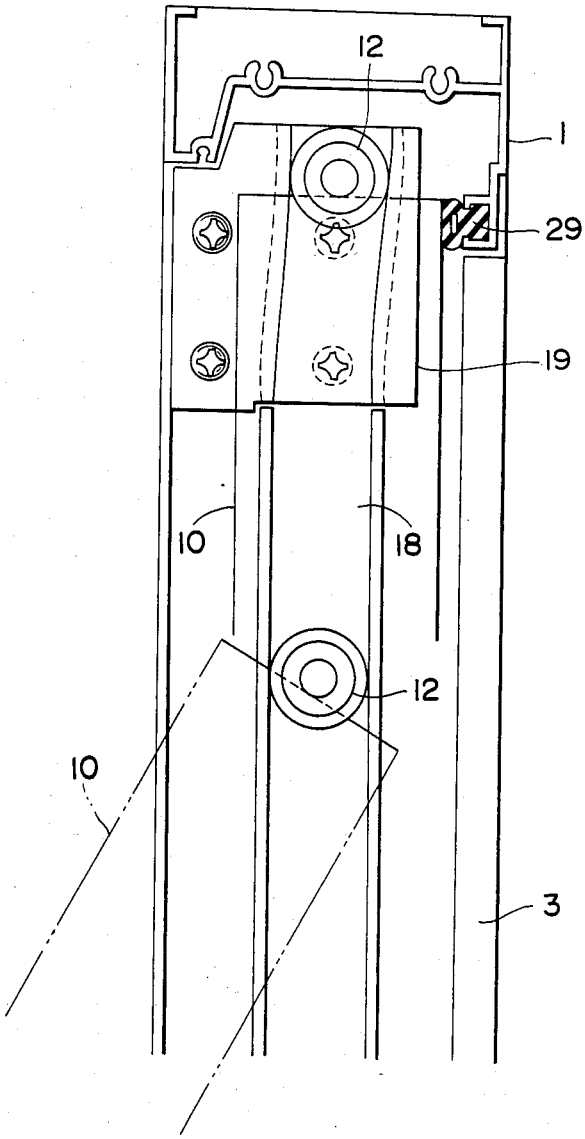

On the other hand, a concave groove 18 is provided on each of opposite surfaces of the left-side vertical window frame member 2 and right-side vertical window frame member 3 over a substantially whole length thereof as shown in FIG. 2. Each roller 12 at the upper end of the sash member 10 is moveably disposed in a concave groove 18 for movement in the up and down direction. Moreover, a concave groove forming member 19 having a different structure is attached to the upper end of each concave groove 18 as shown in FIG. 3, whereby the extension of each concave groove 18 is somewhat inclined at the upper end side toward the indoor side.

Figure 4:
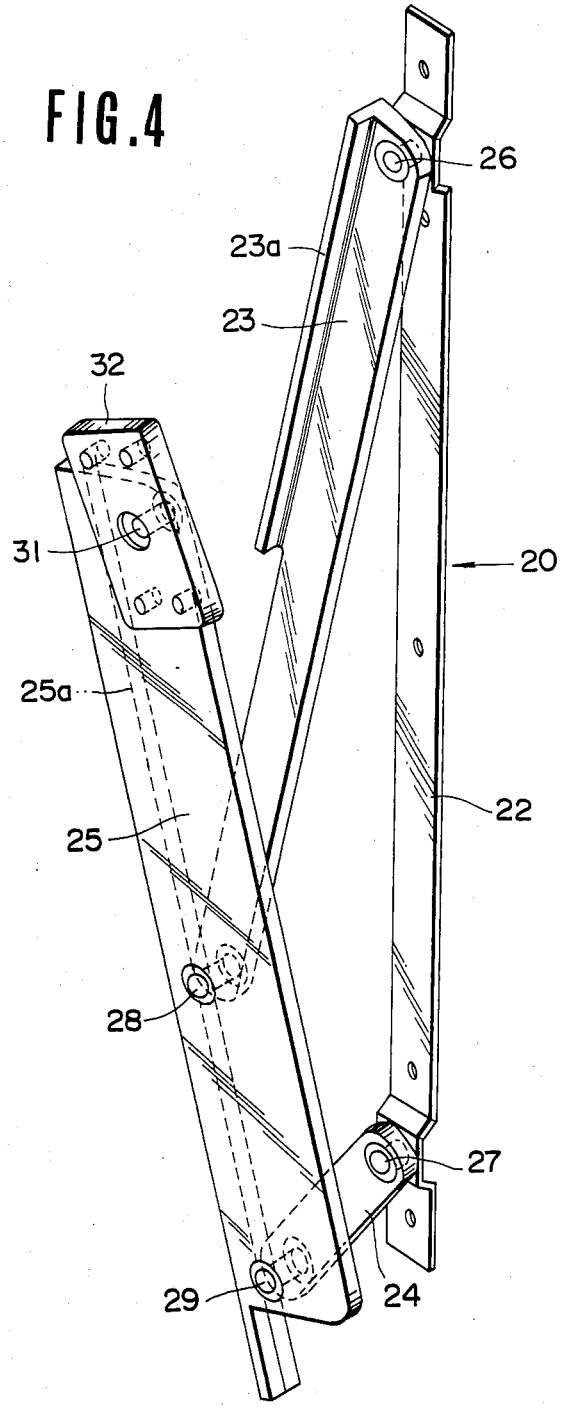

To each of the left-side and right-side vertical window frames 2,3 is attached a link assembly 20 as shown in FIG. 4. (The link assembly to be attached to the left-side vertical window frame member 2 is omitted in FIG. 2.)

The link assembly 20 comprises a fixed link member 22 secured to the vertical window frame member 2 or 3 through a screw 21, first and second movable link members 23, 24 pivotably connected to the fixed link member 22, and a third movably link member 25 pivotably connected to the first and second movable link members 23, 24. More specifically a bent portion at the upper end side of the fixed link member 22 is pivotably connected to the upper end side of the first movable link member 23 through a pivot pin 26, while a bent portion at lower end side of the fixed link member 22 is pivotably connected to the upper end side of the second movable link member 24 through a pivot pin 27. Further, the lower end side of the first movable link member 23 is pivotably connected to the middle portion of the third movable link member 25 through a pivot pin 28, while the lower end side of the second movable link member 24 is pivotably connected to the lower end side of the third movable link member 25 through a pivot pin 29. The upper end side of the third movable link member 25 is pivotably connected by a pivot pin 31 to a bracket 32 for attaching to the sash 10. The bracket 32 is fixed to each of the vertical sash frame members 6, 7 through screws 33 as show in FIG. 2 (omitted at the side of the vertical sash frame member 6). In this case, the pivot pin 31 makes a pivot center of the supported portion of the sash 10, so that the supported portion is positioned to each of the vertical sash frame members 6, 7 at substantially the same level as the gravity center of the sash 10. Moreover, the first and third movable link members 23, 25 are provided at the outdoor side of their edge surfaces with flange portions 23*a* and 25*a*, respectively, whereby the link assembly 20 is not seen from exterior in the closed state of the window.

The lengths of the fixed link member 22 and the first, second and third movable link members 23, 24, 25 as well as the positions of the pivot pins 26, 27, 28 and 29 are so determined that the position of the pivot pin 31 at the third movable link member 25 moves on an approximately linear trajectory in a substantially horizontal direction or a direction substantially perpendicular to the fixed link member 22 when moving the first, second and third movable link members 23, 24 and 25.

Figure 5A:
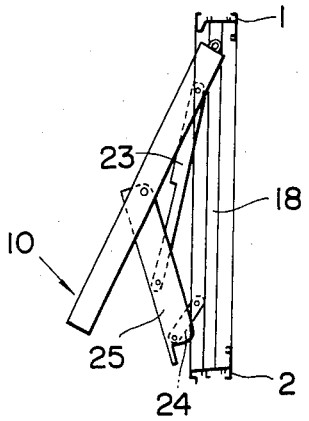
FIGS. 5*a* to 5*c* are schematic views successively illustrating the reversing stage of the reversible window structure.
Figure 5B:
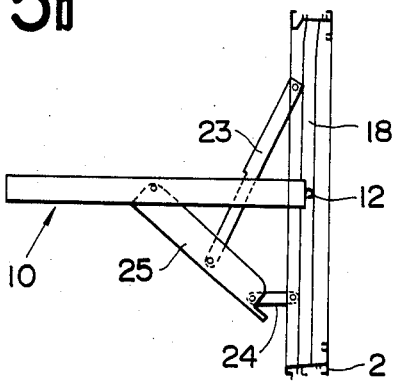
Figure 5C:
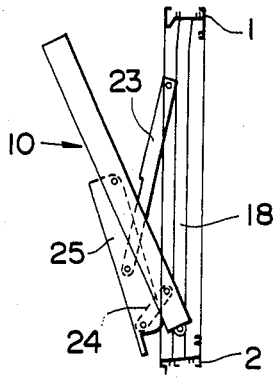
Figure 6:
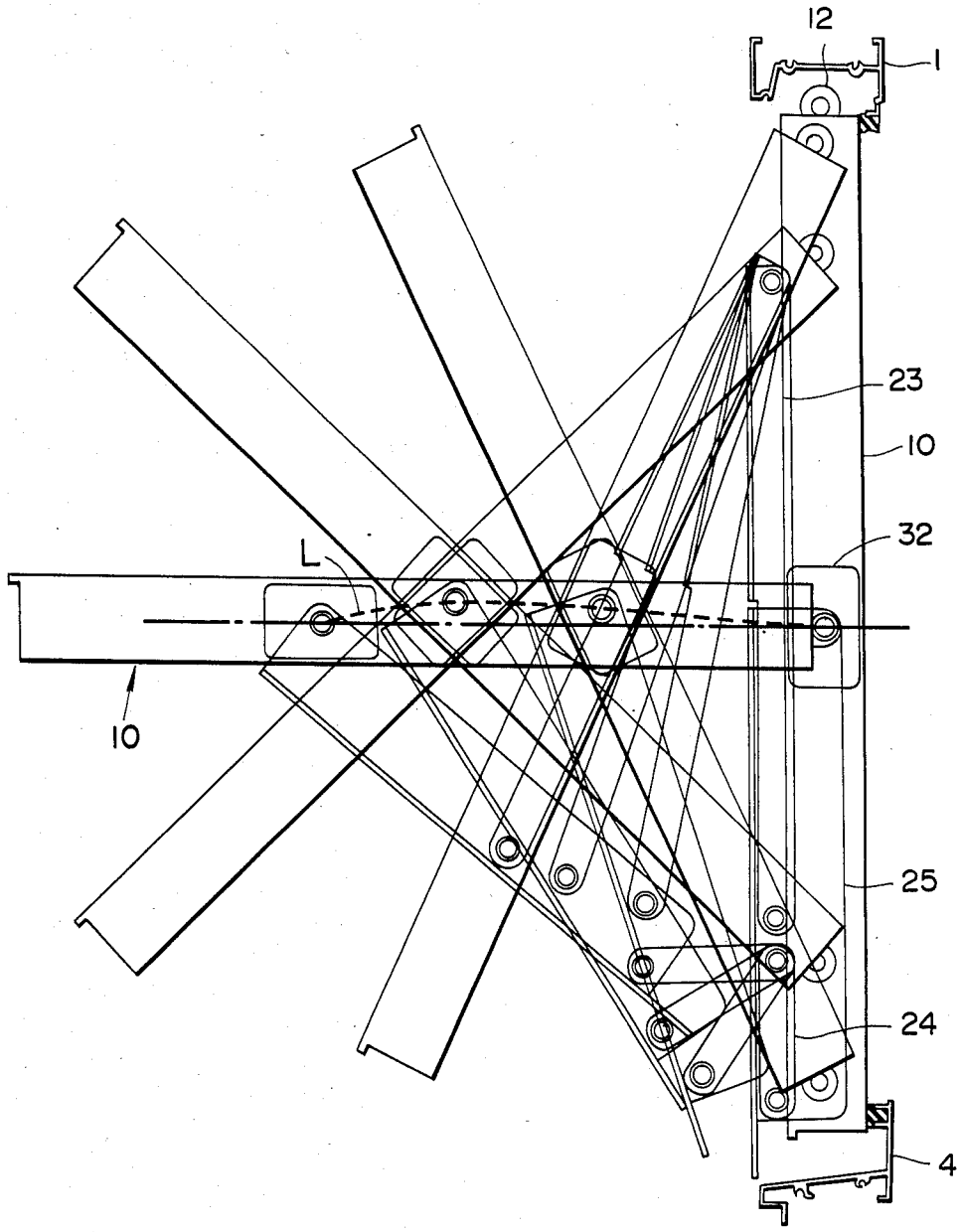

For instance, in case of a window having an opening height in up and down direction (H) of 500 mm, the dimensions of the link assembly may be selected as follows:

Central distance between the pivot pins 26 and 28 in the first movable link member 23: 319 mm, Central distance between the pivot pins 27 and 29 in the second movable link member 24: 70 mm, Central distance between the pivot pins 28 and 29 in the third movable link member 25: 91 mm, Central distance between the pivot pins 28 and 31: 146 mm, Distance between central lines passing through centers of the pivot pins 28 (29) and 31 in parallel to long side of the third movable link member 25: 26 mm, Then, the movement of the aforementioned reversible window structure is described with reference to FIGS. 5 and 6. In this case, the reversing stages of the sash 10 are separately shown in FIGS. 5*a* to 5*c* and they are shown at an overlapped state in FIG. 6.

That is, the roller 12 disposed on the upper end of the sash 10 is inserted into the concave groove 18 of each of the left-side and right-side vertical window frame members 2, 3, while the bracket 32 is pivotably connected to each of the vertical sash frames 6, 7 at a position substantially corresponding to the gravity center of the sash 10 through the pivot pin 31. Now, when the low end portion of the sash 10 is pushed toward the outdoor direction at the above mentioned state, the roller 12 moves downwards inside the concave groove 18 while holding the gravity center of the sash 10 at substantially the same level through the pivot pin 31 existent in the upper end portion of the third movable link member 25 of the link assembly 20. Then, the lower end of the sash 10 is further pushed toward the outdoor direction so as to move the upper end of the sash 10 downwards, during which the gravity center of the sash 10 is also held at substantially the same level by the link assembly 20 and at the same time it moves on a trajectory of line L shown in FIG. 6 at a substantially horizontal state in the outdoor direction. When the sash 10 reaches a substantially horizontal state and is further reversed in a clockwise direction, the gravity center of the sash 10 moves on the trajectory of the line L in the indoor direction, so that there is caused no change of the gravity center in up and down direction. Therefore, the reversing operation of the sash 10 can be conducted very stably through a considerably light operating force. Finally, the sash 10 is pushed downward at the side of the roller 12 to change into the reversed state.

After the outdoor side surface of the window glass 9 is cleaned at such a reversed state, the upper portion of the sash 10 is again pushed in the outdoor direction, while the lower portion thereof is pulled upwards. Thereby, the roller 12 moves from the bottom toward the top inside the concave groove 18, during which the sash member 10 is reversed in the counterclockwise direction, whereby the gravity center of the sash 10 is moved on the trajectory of the line L shown in FIG. 6 at the substantially horizontal state in the order opposite to the above mentioned order.

Thereafter, when the roller 12 reaches to the upper end of the concave groove 18, the other roller 14 strikes on the guide member 38 attached to the lower surface of the upper window frame member 1, while the upper end portion of the sash 10 is pushed toward the seal 29 disposed on the upper part of the window frame assembly because the concave groove 18 is inclined toward the indoor side. Consequently, the lock handle 15 is rotated to push the lower end portion of the sash 10 toward the seal member 29 disposed on the lower part of the window frame assembly, whereby sufficiently improved airtightness and sound insulating properties can be ensured.

As mentioned above, according to the reversible window structure of the invention, one end of the sash is freely moved along the vertical window frame members in up and down direction, while the vertical sash frame members are pivotably supported at substantially the same level as the gravity center of the sash and the thus supported portion can be guided in the outdoor direction in a substantially horizontal state. Therefore, the gravity center of the sash is moved in the substantially horizontal direction during the reversing of the sash and there is caused no large fluctuation of the gravity center in the up and down direction as in the conventional window structures, so that the reversing operation of the sash can stably be conducted through a considerably light operating force. Further, the sash is always supported by that portion of the vertical sash frame members which locates at the same level as the gravity center of the sash, so that there is produced no cantilever state of the sash as in the conventional window structure. As a result, even when the invention is applied to windows having a larger opening width, there is caused no deformation of the sash frame assembly and consequently the airtightness and sound insulting properties of the window structure can satisfactorily be retained over a long period of time. Moreover, the sash never protrudes from the window frame assembly toward the indoor side in the reversing, so that the reversing operation can be conducted very safely without injuring any person existent in the indoor side. Therefore, even if a curtain, blind or the like is arranged at the indoor side of the window structure, it never impedes the reversing of the sash and also the outdoor side surface of the window glass can safely be cleaned at the indoor side without troubles after the reversing of the sash.

What is claimed is:

1. A reversible window structure comprising:

a window frame assembly comprised of upper and lower window frame members and vertical window frame members defining a rectangular opening;

a sash housed in said window frame assembly comprising upper and lower sash frame members, vertical sash frame members and a rectangular window glass supported by said sash frame members;

complementary guide means mounted on opposite sides of said sash at the upper end thereof adjacent said upper sash frame member and on said vertical window frame members for freely guiding the upper end of said sash for movement along a substantially vertical path; and support means comprised of a pair of link assemblies each including first and second movable link members pivotably connected at one end thereof to said vertical window frame members adjacent the top and bottom thereof and a third movable link member pivotally connected to the opposite end of said first and second movable link members, said third movable link member being pivotally connected at the middle portion thereof to said opposite end of said first movable link member and being pivotally connected adjacent one end to said opposite end of said second movable link member with the opposite end portion of said third link movable being pivotally connected to said sash at substantially the center of gravity of said sash, whereby upon pivotal movement of said sash about said guide means the pivot connections between said sash and each third link member will move along a substantially horizontal path perpendicular to said vertical path.

2. A reversible window structure comprising:

a window frame assembly comprised of upper and lower window frame members and vertical window frame members defining a rectangular opening;

a sash housed in said window frame assembly comprising upper and lower sash frame members, vertical sash frame members and a rectangular window glass supported by said sash frame members;

complementary guide means mounted on opposite sides of said sash at the upper end thereof adjacent said upper sash frame member and on said vertical window frame members for freely guiding the upper end of said sash for movement along a substantially vertical path; and support means comprised of a pair of link assemblies each including a fixed link member secured to said vertical window frame member, first and second moveable link members pivotally connected at one end thereof to said fixed link member adjacent opposite ends of said fixed link member and a third movable link member pivotally connected to the opposite ends of said first and second movable link members, said third movable link member being pivotally connected at the middle portion thereof to said opposite end of said first movable link member and being pivotally connected at one end adjacent to said opposite end of said second movable link member with the opposite end portion of said third moveable link member being pivotally connected to said sash at substantially the center of gravity of said sash, whereby upon pivotal movement of said sash about said guide means the pivot connections between said sash and each third link member will moveable along a substantially horizontal path perpendicular to said vertical path.

* * * * *